United States Patent [19]

Peekna

[11] Patent Number: 4,625,928

[45] Date of Patent: Dec. 2, 1986

[54] METHOD OF MAGNETIC CYLINDER ASSEMBLY

[75] Inventor: Andres Peekna, Hinsdale, Ill.

[73] Assignee: R. R. Donnelley & Sons Company, Chicago, Ill.

[21] Appl. No.: 736,062

[22] Filed: May 20, 1985

Related U.S. Application Data

[62] Division of Ser. No. 610,044, May 14, 1984, abandoned.

[51] Int. Cl.[4] ..... B41F 27/02; B41F 27/06; B65H 81/00; H01F 7/02

[52] U.S. Cl. ..... 242/7.02; 29/148.4 D; 101/382 MV; 101/415.1; 335/288

[58] Field of Search ..... 242/7.02, 7.03; 29/148.4 D; 335/285, 288, 295; 101/382 MV, 395, 415.1, DIG. 12

[56] References Cited

U.S. PATENT DOCUMENTS

| | | | |
|---|---|---|---|
| 3,643,311 | 2/1972 | Knechtel et al. | 101/382 MV |
| 3,810,055 | 5/1974 | Wright | 335/285 |
| 3,824,926 | 7/1974 | Fukuyama | 101/382 MV |

*Primary Examiner*—Billy S. Taylor
*Attorney, Agent, or Firm*—Wood, Dalton, Phillips, Mason & Rowe

[57] ABSTRACT

A magnetic cylinder and plate for offset printing. The cylinder has annular magnets and pole pieces. The magnetic circuit is completed through a printing plate. The magnetic flux substantially saturates the pole pieces and plates. The area ratio of the pole pieces to the magnets is greater than about 0.45 to 1 and preferably about 0.6 to 1. In assembling the magnets and cylinder, the magnets are wrapped into slots between the pole pieces. The magnets are angularly displaced so that the leading magnet is positioned between the pole pieces before it is in proximity to the trailing magnet and demagnetization of the magnets is minimized.

2 Claims, 7 Drawing Figures

FIG. 1
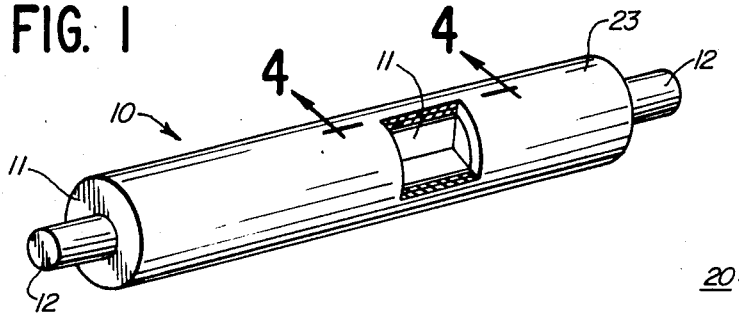
FIG. 2
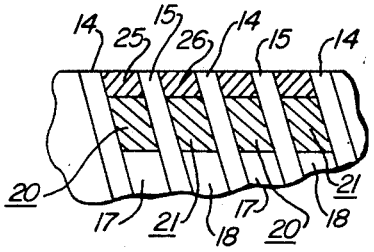
FIG. 3 PRIOR ART
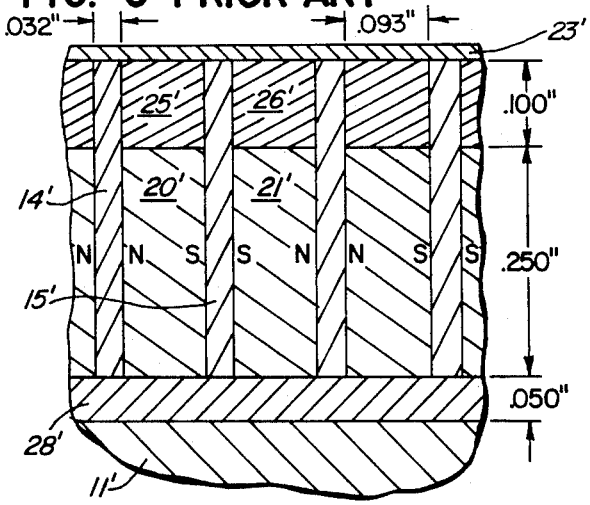
FIG. 4
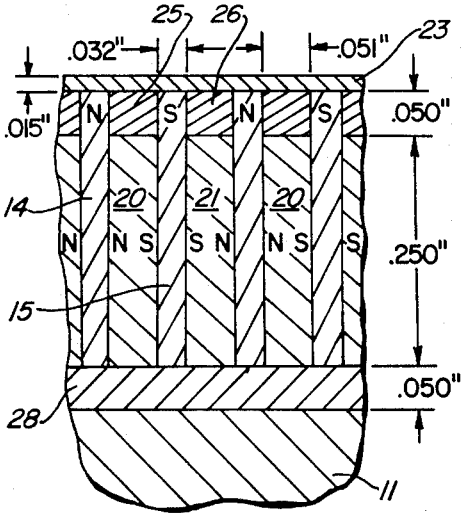
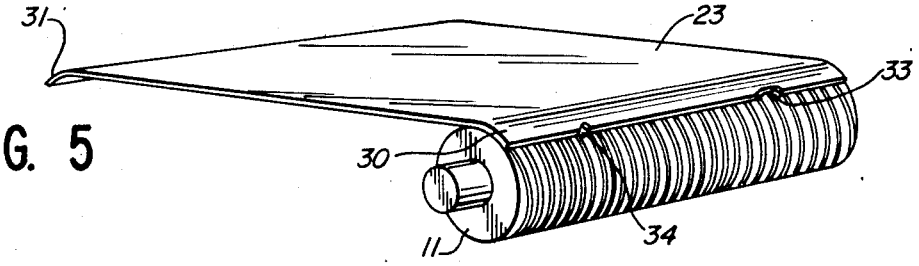
FIG. 5
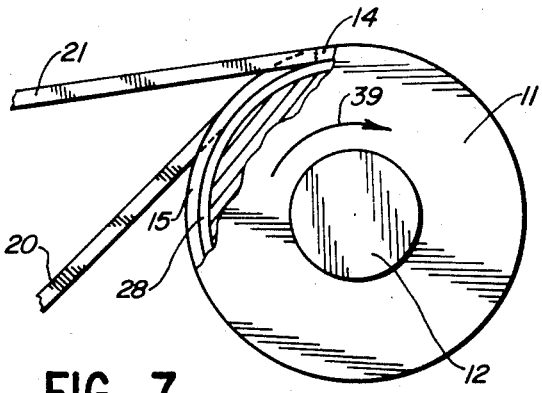
FIG. 7
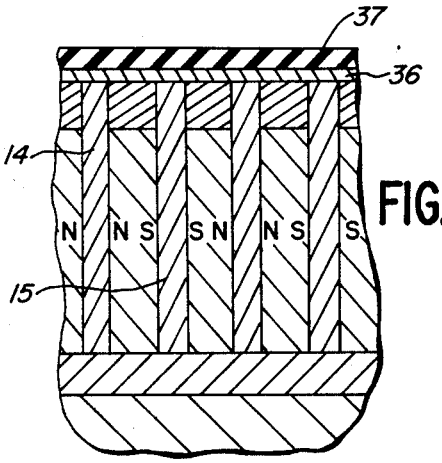
FIG. 6

METHOD OF MAGNETIC CYLINDER ASSEMBLY

This application is a division of Peekna Ser. No. 610,044 filed May 14, 1984.

DESCRIPTION

This application relates to a method of assembling a magnetic cylinder as for use in rotary offset printing.

In rotary offset printing, ink is applied to a plate mounted on one cylinder. The ink is transferred to a resilient blanket on a second cylinder. A paper web is imprinted with the ink on the blanket. The plate and blanket cylinders have to accommodate a mechanism to hold the plate or blanket on the cylinder surface. This mechanism is typically located in a gap extending axially of the cylinder and having a peripheral dimension of the order of three-eights inch. That portion of the web which passes the blanket cylinder gap is not imprinted and represents scrap. This results in a waste of paper and a significant expense. Moreover, the cylinders in a rotary offset press rotate at a high speed and with substantial pressure between cylinders. The gaps described above cause shock and vibrations which degrade printing quality and contribute to press maintenance problems. The gaps also destroy the symmetry of the cylinders, an undesirable condition in high speed rotation.

Cylinders have been proposed to which a plate is held magnetically. Magnetic cylinders which have been available do not have sufficient holding capability for reliable operation in rotary web offset printing.

SUMMARY OF THE INVENTION

In accordance with the invention, the method of assembling the magnetic cylinder, includes the steps of providing a cylinder with two spaced apart helical pole pieces defining two magnet receiving slots on the cylinder surface and winding two flexible magnets on the cylinder. One magnet is wound in one slot and the other magnet is wound in the adjacent slot. The magnets have like poles facing each other. The magnets enter the slots with an angular displacement such that one magnet leads the other magnet, to minimize demagnetization of each of the magnets by proximity to the field of the other magnet.

Further features and advantages of the invention will readily be apparent from the following specification and from the drawings.

BRIEF DESCRIPTION OF THE DRAWINGS

FIG. 1 is a perspective view of a cylinder and plate incorporating the invention, with a section cut away;

FIG. 2 is an enlarged fragmentary view showing a portion of the cylinder surface with the pole pieces in elevation and the magnets in section;

FIG. 3 is an enlarged fragmentary section of the magnetic structure and plate of a prior art cylinder;

FIG. 4 is an enlarged fragmentary section of the magnetic structure and plate illustrating the invention, taken along line 4—4 of FIG. 1;

FIG. 5 is a perspective showing the plate as it is mounted on the cylinder;

FIG. 6 is a view similar to FIG. 4 with an offset blanket on the surface of the cylinder; and FIG. 7 is a diagrammatic end view of the cylinder, with a portion broken away, illustrating the winding of the magnets into the gaps between the pole pieces.

The printing roll 10, FIG. 1, has a cylindrical body 11 with stub shafts 12 extending from each end. The cylindrical body is preferably of the general construction shown in Wright U.S. Pat. No. 3,810,055. On the surface of the cylindrical body, two helical pole pieces 14, 15, FIG. 2, are spaced apart defining helical slots 17, 18. Magnets 20, 21 are located in the slots establishing a magnetic field through the pole pieces. The field holds a plate 23 on the surface of the cylinder. The plate 23 is not shown in FIG. 2.

The magnets have a radial dimension less than the pole pieces. Annular members 25, 26 overlie the magnets, filling the outer portion of the slots 17, 18.

A typical printing cylinder is of the order of 40 inches in length and has a diameter of the order of 7.5 inches. The magnetic structure on the cylinder surface has, as will appear, a radial dimension of less than one-half inch.

The prior art magnetic structure of FIG. 3 may be compared with the magnetic structure of the present cylinder and plate in FIG. 4. Elements in the prior art construction of FIG. 3 corresponding with the elements of FIGS. 1, 2 and 4 will be identified with the same reference numeral and a prime mark. Differences in geometry and in the characteristics of the materials afford a substantial increase in the force holding the printing plate on the cylinder. The dimensions shown in FIGS. 3 and 4 and referred to in the specification provide examples of the prior art and the invention for purposes of comparison. While individual dimensions are not critical, the relative dimensions of the elements of FIG. 4 contribute to the increased plate holding force achieved by the invention.

The cylinder body 11, which may be of steel, has a sleeve 28 of a nonmagnetic material thereon to isolate the magnetic structure from the body. Typically, the sleeve is of brass and has a radial dimension of 0.050 inch.

The magnets 20, 21 are preferably a flexible rubber-like material impregnated with magnetic particles. Minnesota Mining and Manufacturing Company sells such magnets under the trademark Plastiform. The magnets are wound into the slots 17, 18 between the pole pieces 14, 15 during assembly of the cylinder, as will appear. The fields of the magnets are oriented with like poles of adjacent magnets facing each other, as indicated in the drawing. The magnets have an axial dimension of 0.051 inch and a radial dimension of 0.250 inch. The pole pieces, 14, 15 are of a low reluctance material, preferably a stainless steel. AISI No. 430 ferritic stainless steel is suitable. This material resists corrosion by the inks, solvents and cleaners used in printing so that the peripheral surfaces of the pole pieces maintain the desired dimension and cylindrical configuration. The axial dimension of the pole pieces, here 0.032 inch, is determined by the coercive force and axial dimension of magnets 20, 21 and the permeability of the pole piece material so that a condition of substantial saturation is achieved at the peripheral faces of the pole pieces with the printing plate mounted on the cylinder.

The printing plate 23 is of a magnetic material and has a thickness related to its reluctance such that substantial saturation is achieved in the annular plate sections between adjacent pole pieces 14, 15. In the example illustrated in FIG. 4, the plate has a thickness of 0.015 inch. This thickness permits easy cutting, handling and preforming of the end sections to conform with the cylinder surface as will be described below.

It is preferred that the magnetic field through plate 23 not exceed saturation. The existence of a stray field outside the plate would attract particles of magnetic material to the plate surface. This would result in poor printing quality and could damage the plate or the blanket. Furthermore, such a stray magnetic field does not contribute to the force holding the plate on the cylinder but rather detracts therefrom. The force required to lift an end of the plate from the cylinder, sometimes referred to as the "peel-off force", is directly related to the three-quarter power of the plate thickness. This relationship exists throughout the range in which the curve of the hold down force per unit area as a function of the gap between the plate and the pole pieces is substantially linear. Based on both measured and calculated data, the curve is substantially linear until the peel-off force is reduced to about 40 to 50% of its initial value. The plate must be thick enough that the peel-off force is sufficient that the plate is not peeled from the cylinder by tacky ink. An excessive plate thickness, however, increases the difficulty of cutting, handling and forming the plate and of mounting it on a cylinder.

The term "substantial saturation" as used herein means a condition of saturation of the order of 90–95%. A design to achieve a higher level of saturation requires an excessive increase in magnet coercive force and/or axial dimension for a minimal increase in flux. Moreover, at such a high level of saturation a stray field begins to appear outside the plate, diminishing the gain in the peel-off and hold down forces. A flux level much below 90% saturation represents inefficient utilization of the material in the pole pieces and plate.

The annular members 25, 26 overlying the magnets 20, 21 between the outer portions of the pole pieces 14, 15 are of a high reluctance material to minimize the flux path in shunt with plate 23. An austenitic stainless steel, AISI No. 310, has been found satisfactory.

The outer peripheral surface of the pole pieces and the inner surface of plate 23 are preferably in intimate contact. This minimizes the occurrence and size of air gaps in the magnetic circuit. Any air gap greatly increases the circuit reluctance and reduces the hold down force acting on the plate.

The advantages of the construction of FIG. 4 will be appreciated from a consideration of the prior art construction of FIG. 3. Here, the magnets 20', 21' have an axial dimension of 0.093 inch. The coercive force is such that the pole pieces 14', 15' are saturated and the magnetic hold down force potentially available is not effectively used. The annular magnet cover members 25', 26' have a radial dimension of 0.100 inch and are of a stainless steel, AISI No. 304, which typically has a lower reluctance than that of the AISI No. 310 material. The cover members provide a significant magnetic shunt path reducing the flux in plate 23' and thus reducing the hold down force.

The hold down force is localized at the pole pieces 14', 15'. With the prior art magnet width of FIG. 3, there are four sets of magnets and pole pieces per axial inch of the cylinder. The ratio of pole piece to magnet area on the outer surface of the cylinder is 0.34 to 1. With the construction of FIG. 4, there are six sets per axial inch. The ratio of pole piece to magnet area is 0.63 to 1. These differences in geometry and magnetic characteristics of the elements provide an increase of the order of 50% in the peel-off force and of the order of 80% in the hold down force exerted on the plate 23 as compared with the forces on plate 23'.

The peel-off force required to lift an end of plate 23 is proportional to the hold down force when the plate is in contact with the pole pieces and is inversely proportional to the fourth root of the proportionality constant between the hold down force and the gap between the plate and the pole pieces. This measure of the ability to resist a peel-off force is accurate when the relation between the hold down force and the gap is linear over the first 46% of the peel-off force decrease, and when the bending of the plate as the end is lifted does not exceed the mechanical yield strength of the plate material. Tacky ink will exert such a peel-off force. If the plate end is lifted too far, the plate will shift in position on the cylinder or may come off. As discussed above, it is desirable that the gap between the plate and pole pieces be minimized and that the inner surface of the plate have intimate contact with the pole pieces throughout the circumference and the length of the plate.

An additional factor to enhance the intimate contact between the plate and pole pieces is precurving the leading and trailing ends 30, 31 respectively of the plate as shown in FIG. 5. The curvature is preferably on a radius substantially equal to or slightly less than the radius of the cylinder surface. This aids in establishing and in maintaining an intimate contact between the plate and the pole pieces at the ends of the plate where it is most important.

FIG. 5 also illustrates a preferred construction for locating the plate 23 on the cylinder. Positioning pins 33, 34 extend radially outwardly from the cylinder surface. A semi-circular complementary notch and an elongated notch in the edge of the plate receive the pins and locate the plate on the cylinder while allowing for manufacturing tolerances. After positioning the plate end 30 as shown, the remainder of the plate is wrapped around the cylinder surface.

The plate 23, FIGS. 1, 4 and 5 is a printing plate. An image of the material to be printed is suitably formed on the outer surface to pick up ink from an inker in an offset printing operation. As illustrated in FIG. 6, the magnetic cylinder may also be used for the resilient blanket. Here, the cylinder and magnetic structure may be the same as in FIG. 4. The plate 36 has the resilient blanket sheet 37 suitably affixed to its outer surface. As in FIG. 4, plate 36 is of a magnetic material with a reluctance and radial dimension such that it is substantially saturated by the flux between pole pieces 14, 15. The inner surface of plate 36 has intimate contact with the peripheral outer surface of the pole pieces.

Magnetically mounted blankets have sometimes exhibited a tendency to creep or shift peripherally on the cylinder surface. The cause of this movement is not fully understood but it is believed to be due to a localized separation of the plate 36 from the cylinder surface. Maximization of the hold down force is one factor in eliminating this movement. An increase in the pole piece to magnet area ratio above the 0.63 to 1 ratio of the cylinder construction described above has been found to provide a higher hold down force at a very small gap dimension, e.g., less than 0.0005 inch. With such a higher area ratio, however, the hold down force drops rapidly as the gap increases. With an area ratio between about 0.45 to 1 and about 0.65 to 1 a high hold down force at very small gap is achieved, with an acceptable decrease as the gap increases. As described above, the peel-off force required to pull the plate off from its end is thereby maximized.

FIG. 7 illustrates the method of assembly of the flexible magnets 20, 21 with the cylinder. The cylindrical body 11 has the sleeve 28 and pole pieces 14, 15 mounted thereon. The flexible magnets are then wound into the slots 17, 18 between the pole pieces as by rotating the cylinder in the direction of arrow 39. The magnets are oriented with like pole pieces adjacent. If the magnets are brought into close proximity with this orientation, the field of each magnet tends to demagnetize the other. In accordance with the invention, the magnets are angularly displaced with one magnet 20, which may be considered the leading magnet, completely in the slot between adjacent pole pieces before the trailing magnet 21 enters the adjacent slot. Thus, the pole pieces are interposed between the magnets before the magnets come into close proximity. Demagnetization of the magnets during assembly is minimized.

If the pole pieces have been work hardened during manufacture, the reluctance may increase. Annealing will reduce the reluctance, maximizing the holding capability. A combination of annealing and the magnet assembly method described above has increased the holding forces by a factor of about 1.2 over those of the prior art cylinder of FIG. 3.

I claim:

1. In the method of assembling a magnetic cylinder, comprising providing a cylinder with two spaced apart helical pole pieces defining two magnet receiving slots on the cylinder surface;

winding two flexible magnets on said cylinder, one in one slot and the other in the adjacent slot, the magnets having like poles facing each other;

the improvement wherein:

the magnets are positioned to enter the slots with an angular displacement such that one magnet leads the other to minimize demagnetization of each magnet by proximity to the field of the other magnet.

2. The method of assembling the magnetic cylinder of claim 1 in which the angular displacement of the magnets is such that the leading magnet is substantially completely in the slot between pole pieces before the trailing magnet enters the adjacent slot, the pole pieces between the slots shielding each magnet from the field of the other magnet.

* * * * *